United States Patent [19]

Bornand

[11] 3,934,406

[45] Jan. 27, 1976

[54] BALANCE WHEEL ASSEMBLY AND METHOD FOR MANUFACTURE THEREOF

[75] Inventor: Rene Bornand, Bienne, Switzerland

[73] Assignee: OMEGA Louis Brandt & Frere S.A., Switzerland

[22] Filed: Nov. 5, 1974

[21] Appl. No.: 521,062

[30] Foreign Application Priority Data

Nov. 29, 1973 Switzerland ..... 16753/73

[52] U.S. Cl. ..... 58/140 R

[51] Int. Cl.[2] ..... G04B 13/02

[58] Field of Search ..... 58/140 R, 59

[56] References Cited

UNITED STATES PATENTS

| | | | |
|---|---|---|---|
| 387,247 | 8/1888 | Morlet | 58/140 R |
| 988,139 | 3/1911 | Petta | 58/140 R |
| 1,136,595 | 4/1915 | Freistadter | 58/140 R |
| 2,174,122 | 9/1939 | Conyne et al. | 58/140 R |
| 3,393,506 | 7/1968 | Garbe | 58/140 R X |

*Primary Examiner*—George H. Miller, Jr.

*Attorney, Agent, or Firm*—Griffin, Branigan & Butler

[57] ABSTRACT

A balance wheel assembly includes a balance staff having a balance wheel hub, a saddle, a shoulder, a cylindrical portion to which the balance spring is attached, and a lower stem extending through a flange. The saddle and cylindrical portion are on the same side of the hub with the shoulder being on the opposite side of the hub and spacing the flange from the hub. The balance spring is attached directly to the cylindrical portion of the balance staff.

7 Claims, 3 Drawing Figures

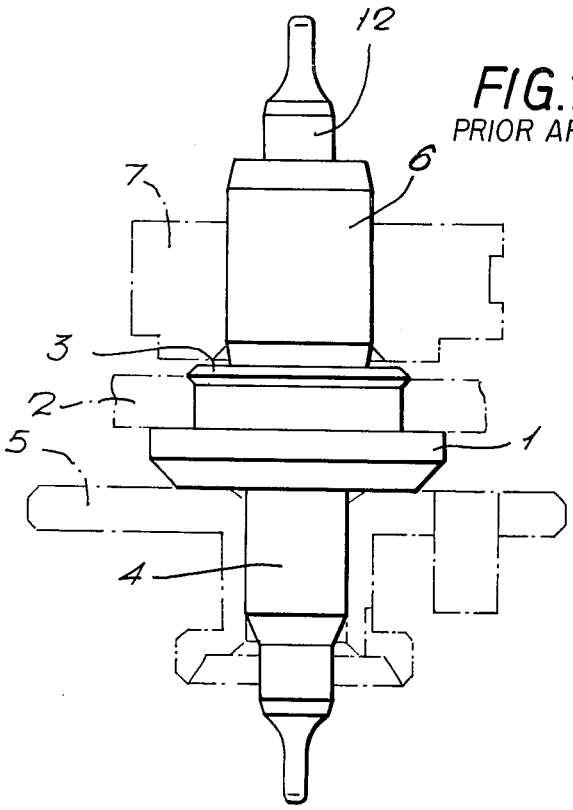
FIG.1.
PRIOR ART
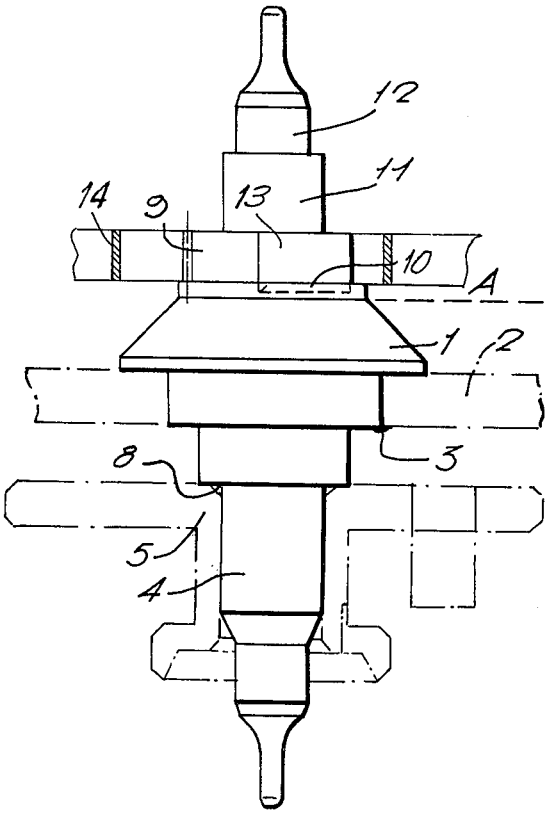
FIG.2.
FIG.3.
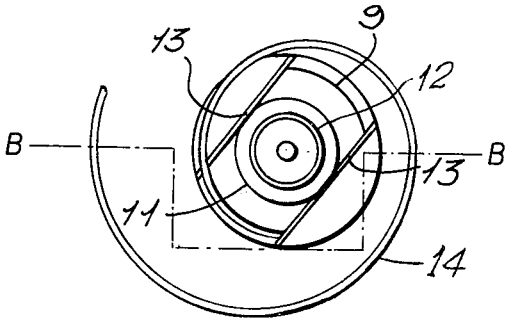

BALANCE WHEEL ASSEMBLY AND METHOD FOR MANUFACTURE THEREOF

The invention concerns a balance wheel assembly for timepiece mouvements for which the manufacture relative to existing methods has been simplified while at the same time enabling an improvement in the isochronism. The invention likewise concerns a method of manufacture of the assembly.

In known balance wheel assemblies the balance spring is fastened to the staff through a supplementary part, the collet, which is pressed onto the staff and on which or in which the interior end of the balance spring is fastened. This arrangement causes a certain number of inherent difficulties, among others the assembling thereof is a delicate operation, the elastic characteristics of the spring may be accidentally changed through introduction of strains thereby disturbing the isochronism, and the axial positioning of the balance spring depends on the riveting of the balance wheel hub and the length of the bore in the collet, other problems are also brought out by the centering and flattening of the balance spring.

Various attempts have been made to overcome these difficulties, for example, it has been suggested to glue the balance spring in a slot or opening radially arranged within a staff shoulder or else to imbed and glue the balance spring in an orifice arranged in a groove provided in a flange during manufacture of the staff. These suggestions have failed to give complete satisfaction. If they avoid difficulties originating from the collet there is nevertheless always an increase in the diameter of the staff, for the shoulder or the flange, thus the center portion of the balance spring remains rather large. The problems of assembly moreover are not much diminished from those which arise from the fastening of the balance spring to the collet.

This invention avoids such difficulties and teaches a balance wheel assembly for which the staff is arranged in a manner to permit the fastening of the balance spring directly onto a portion of the staff having a radius much less than that of known collets, while assuring staff positioning and spring centering and flattening of excellent qualities. The reduced radius of the staff and the absence of the collet enable a considerable economy in material and at the same time bring about a decrease in the moment of inertia of the staff and of the assembly. Such advantages, which in practical terms bring about important benefits for the assembly operations, thus in the costs, and at the same time a notable improvement in the isochronism, above all if in the vertical position, are attained through use of a balance wheel assembly wherein the staff is arranged in a manner such that the balance wheel hub and the plane of the balance spring are situated on opposite sides of the saddle. The balance spring is fastened to a portion of the staff of reduced diameter above the saddle and axially positioned by the latter. The flange is mounted on the staff on the same side as the hub of the balance wheel.

The invention also concerns a method of manufacture concerning the balance wheel assembly wherein the balance spring is fastened directly to the staff with no intermediate component by glueing or welding, the placing into beat of the balance wheel assembly being effected following assembling thereof by rotation of the flange around the staff.

For the details of the invention reference will now be had to the detailed description which follows and in which reference is made to the following drawings:

FIG. 1 represents a balance assembly staff according to the prior art.

FIG. 2 shows to the same scale a balance assembly staff in accordance with the invention, the balance spring being shown in section along the line B—B as viewed in FIG. 3.

FIG. 3 is a top view down to plane A of FIG. 2.

FIG. 1 showing the prior art may be detailed as follows: An assembly may comprise the saddle 1 on which the hub 2 of the balance wheel is fastened by means of riveting 3; 4 is the lower stem portion which is adjusted to flange 5; 6 is the upper stem portion on which has been pressed collet 7 which carries the balance spring (not shown). It may easily be seen that the axial positioning of the collet 7, thus that of the intermediate plane depends on the riveting 3. Effectively, if the collet is pressed against the riveting 3 there will most frequently appear a non-symmetric deformation of the center of the balance wheel and this may cause serious problems with balancing the assembly. Such, in fact, has been suggested by the publication GREINER INFORMATION No. 2, November 1971, which emphazises the importance of leaving open a space of 0.02 – 0.05 mm between the riveting 3 and the collet 7. In this context precision of positioning of the collet is for the least uncertain.

This serious difficulty is eliminated by the arrangement according to the invention as shown in FIG. 2 in which the various elements have the same reference numbers as their corresponding elements of FIG. 1. In this arrangement the position of saddle 1 is inverted relative to the balance hub 2 which remains constant. Hub 2 may be fastened to saddle 1 by conventional riveting or preferably by spot welding 3. The flange 5 is adjusted on stem 4 and axially positioned by a shoulder 8 having a slightly greater diameter than stem 4.

Above hub 2 saddle 1 has a generally compacted form. Its half cross section will be seen to have the form of a trapezoid of which the longer base edge is proximate the hub. On the side of the shorter base edge the axle comprises a cylindrical portion 9 having a length equal to the height of the balance spring and a radius having the same order of size as that of the prior art stem 6, but at the same time less than that of the shorter base edge of the trapezoid. On crown 10 which is cut back from the upper portion of saddle 1, the fact adjacent cylindrical portion 9 is provided with a circular groove of triangular cross section intended to accomodate the lower edge of the balance spring in order to establish the plane of the latter and to assure the constance thereof during the fastening operations. Cylindrical portion 9 which carries the balance spring is, upwardly elongated by another cylindrical portion 11 having a radius between that of the portion shown as 9 and that of the upper stem 12. Such arrangement thereby provides clearance for the balance spring fastening operations.

It is important that the balance spring at the point of fastening to cylindrical portion 9 and in the vicinity of the latter avoid as much as possible stresses and strains. Thus as shown in FIG. 3 cylindrical portion 9 is milled along two planes 13 parallel to the geometric axis of the assembly and equally distant from such axis. The milling which affects the upper portion or crown 10 of saddle 1 will remove in these particular regions all trace of the previously mentioned groove. On FIG. 3 the milled planes 13 are parallel to one another. To reduce still further the contact surface of a balance spring on the cylindrical surface 9 and thus favour a better spiral development one might also use secant planes, but it would then be desirable to preserve symmetry relative to the axis of the assembly, hence to provide milling along four planes instead of two.

In order to assemble the arrangement starting with a staff according to the preceding description the interior end of the balance spring is brought into contact with the cylindrical portion 9 remaining between the milled planes 13 with the lower edge of the balance spring resting in the groove provided in crown portion 10 of saddle 1. The balance spring is held in position by means of appropriate fixtures not shown since not within the scope of this invention. Fastening is effected by glueing or welding at one or more points along the balance spring. Where the balance spring contacts cylindrical portion 9 fastening through welding is considered preferable since it may be effected without adding material to the assembly. For this particular operation use of laser beam is considered as a useful or even preferred method. Effectively, it will permit the avoidance of all residual thermal strains in view of the extremely short duration of the process, furthermore, it is readily reproducible and in the same way the welding strength is constant. The mechanical characteristics of the balance spring in the welded region are only affected to a negligible extent. The accessibility of the arrangement to a laser beam preferably arranged parallel to the assembly axis to the welding point is particularly easy in view of the existing clearance above the cylindrical portion 9. Any tendency for the balance spring to swing toward the exterior at the moment of welding is prevented by the wedging action provided by the groove.

After the hub 2 of the balance wheel and the balance spring have been fastened to the staff with flange 5 adjusted on the latter the problem of putting the assembly into beat has to be solved. Normally, this is effected by rotating the collet relative to the staff. In the present case, lacking a collet, such an adjustement is not possible, thus following another aspect of the invention the manufacture is completed in putting the assembly into beat through rotation of the flange 5 relative to the staff.

I claim:

1. In a balance wheel assembly including a balance wheel, a balance staff having a shoulder, a balance spring, and a flange which rotates relative to the balance staff, said balance staff including a saddle and a hub for the balance wheel, the improvement wherein said balance wheel hub and the plane of the balance spring are arranged on opposite sides of said saddle, and the flange is completely disengaged from the hub by said shoulder, and wherein the interior end of the balance spring is fastened directly to the balance staff without any intermediate component.

2. The improvement as claimed in claim 1 wherein said balance staff includes a lower stem portion, and wherein said flange is positioned on the same side of the saddle as the balance wheel hub, but axially positioned from said hub by said shoulder portion.

3. The improvement as claimed in claim 1 wherein the balance staff includes a portion adjacent said saddle having a diameter less than that of the saddle, said portion having an axial length equal to the width of said balance spring, and having said balance spring fastened thereto.

4. The improvement as claimed in claim 3 wherein said balance staff further comprises an upper stem, and a cylindrical portion between said upper stem and the portion to which the balance spring is fastened, said cylindrical portion having a diameter greater than said upper stem portion.

5. The improvement as claimed in claim 3 wherein the portion of the staff to which the balance spring is fastened is milled along at least two planes both parallel to and equally distant from the geometric axis of the balance staff.

6. The improvement as claimed in claim 5 wherein said saddle is provided with a circular groove adjacent the portion of the staff which carries the balance spring, said groove maintaining the balance spring in position as it is fastened to the balance staff.

7. The improvement as claimed in claim 6 wherein said balance staff includes a lower stem portion, and wherein said flange is positioned on the same side of the saddle as the balance wheel hub, but axially positioned from said hub by said shoulder portion.

* * * * *